US006062185A

United States Patent [19]

Chiu et al.

[11] Patent Number: 6,062,185

[45] Date of Patent: May 16, 2000

[54] GLOW SENSOR AND ENGINE COMPONENT COMBINATION

[75] Inventors: Randolph Kwok-Kin Chiu; Charles Dale Oakley, both of Davison; Joseph Michael Leptich, Clarkston; Gamdur Singh Mann, Grand Blanc; David Kwo-Shyong Chen, Rochester Hills, all of Mich.

[73] Assignee: General Motors Corporation, Detroit, Mich.

[21] Appl. No.: 09/160,399

[22] Filed: Sep. 25, 1998

[51] Int. Cl.[7] ..... F02B 9/08; F23Q 7/22

[52] U.S. Cl. ..... 123/145 A; 219/270; 219/536; 219/544

[58] Field of Search ..... 123/145 A, 143 B; 219/270, 536, 544, 548

[56] References Cited

U.S. PATENT DOCUMENTS

| | | | |
|---|---|---|---|
| 2,140,943 | 12/1938 | Rudquist | 123/145 A |
| 4,739,731 | 4/1988 | Habich et al. | 123/494 |
| 5,020,489 | 6/1991 | Koji et al. | 123/145 A |
| 5,519,187 | 5/1996 | Hinkle | 123/145 A |
| 5,676,100 | 10/1997 | Dam et al. | 123/145 A |
| 5,880,432 | 3/1999 | Radmacher | 123/145 A |
| 5,893,993 | 4/1999 | Kurano | 123/145 A |

FOREIGN PATENT DOCUMENTS

| | | |
|---|---|---|
| 19737396A1 | 3/1998 | Germany . |
| 19738915A1 | 3/1998 | Germany . |
| WO97/38223 | 10/1997 | Japan . |

*Primary Examiner*—Willis R. Wolfe
*Attorney, Agent, or Firm*—Vincent A. Cichosz

[57] ABSTRACT

A glow sensor provides functions of both a diesel engine glow plug for aiding fuel ignition during starting and low temperature operation and an ion sensor for sensing engine combustion initiation and characteristics. Compact glow sensor components may be assembled directly in combination with an engine combustion chamber defining component, such as a cylinder head, to provide a combination in which separate housings or shells for the glow sensors are not needed. Thus, the glow sensor elements and insulation may be made larger to provide greater electrical resistance in the ion sensor electrical circuit and enhance the operation of the ion sensor function. Various forms of glow sensors may optionally be used in such a combination including, for example, metal sheath type glow sensors with either isolated or non-isolated coils and ceramic rod or flat plate type glow sensors. Exemplary embodiments of glow sensor components mounted in a cylinder head are disclosed.

14 Claims, 4 Drawing Sheets

FIG 5
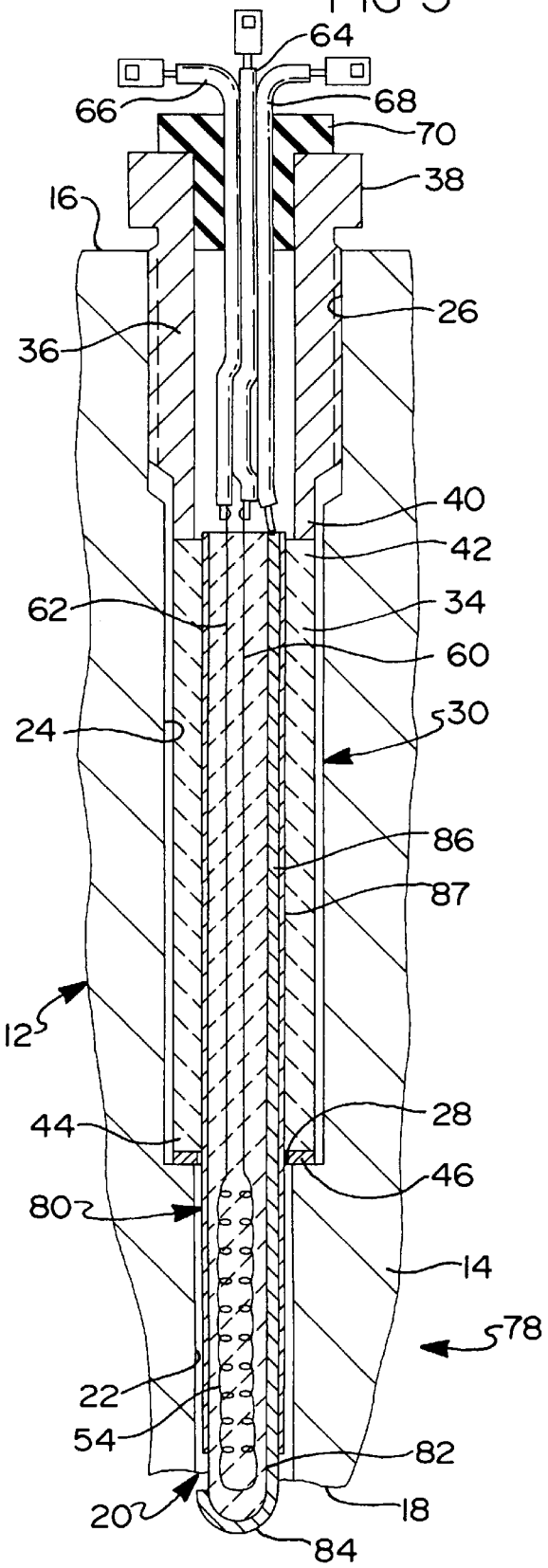
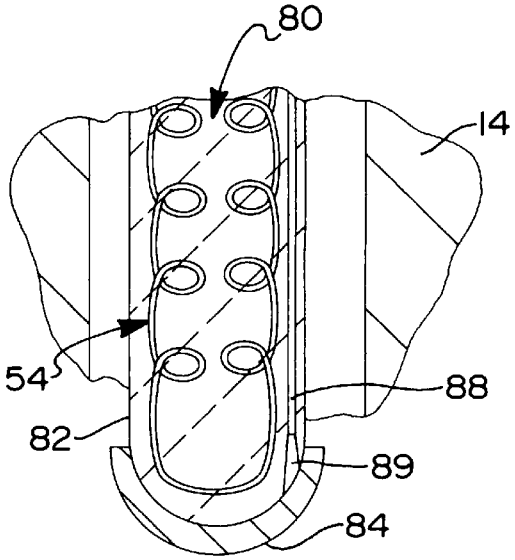
FIG 5A

GLOW SENSOR AND ENGINE COMPONENT COMBINATION

TECHNICAL FIELD

This invention relates to diesel engines and, more particularly, to glow sensors which combine functions of both a glow plug and an ion sensor to promote fuel ignition in an engine combustion chamber during starting and low temperature running and to sense the occurrence and character of combustion events. In particular, the invention relates to a combustion chamber defining engine component and glow sensor combination.

BACKGROUND OF THE INVENTION

It is known in the art relating to diesel engines to provide an ignition glow plug having a heated glow tip which extends into the engine combustion chamber or pre-chamber to promote ignition of fuel, especially during starting and low temperature operation. It is also known in internal combustion engines to provide an ion sensor in the combustion chamber which senses the occurrence of combustion events through variations in current flow across a gap through combustion gases in the chamber. The combination of a ceramic glow plug tip combined with an ion sensor for use in a diesel engine has also been proposed.

SUMMARY OF THE INVENTION

The present invention provides a combination of a diesel engine component, such as a cylinder head, with compact glow sensor components installed in bores of a combustion chamber defining wall and providing functions of both glow plugs and ion sensors. In particular, the invention provides various embodiments of compact glow sensors in combination with a cylinder head. For convenience, the term "glow sensor" is used herein to refer to devices, such as those described herein, for carrying out functions of both a glow plug and an ion sensor.

In general, the invention comprises a combination of a glow sensor and a combustion chamber defining component of a diesel engine, the combination comprising: an engine component including a wall having a combustion chamber defining surface and a mounting bore through the wall and opening through the surface, the bore having a smaller diameter portion at an inner end adjacent the surface, a larger diameter portion spaced from the surface and defining an annular seat adjacent the smaller diameter portion, and securing means adjacent an outer end of the bore; a glow sensor element extending through the bore and having a glow tip protruding out from the smaller diameter portion through the surface; a ceramic sleeve disposed in the larger diameter portion and fixedly connected to and surrounding the element, the sleeve having an annular inner end operatively engaging the annular seat; and a retainer operatively engaging the securing means and having an inner end bearing against an outer end of the sleeve and applying an axial force thereon to force the sleeve outer end against the bore annular seat and retain the glow sensor element in fixed assembly with the component.

The combination provides the desired glow sensor functions while omitting a separate mounting shell which might otherwise be provided for supporting the glow sensor components in an engine cylinder head or the like. Omission of the mounting shell from the glow sensor provides more room in the mounting bore of a cylinder head to install a larger and stronger ceramic mounting sleeve and/or a larger sized glow sensor element. Better insulation of the electrical elements may thus be provided, resulting in greater internal resistance that may benefit operation of the ion sensor functions under elevated temperature conditions, where the resistance value of the ceramic insulation is decreased.

These and other features and advantages of the invention will be more fully understood from the following description of certain specific embodiments of the invention taken together with the accompanying drawings.

BRIEF DESCRIPTION OF THE DRAWINGS

In the drawings:

FIG. 5 is a transverse cross-sectional view of a third embodiment of glow sensor and engine component combination formed according to the invention;

FIG. 5A is a fragmentary cross-sectional view showing a variation of the embodiment of FIG. 5;

DESCRIPTION OF THE PRIOR ART

Figure 1:
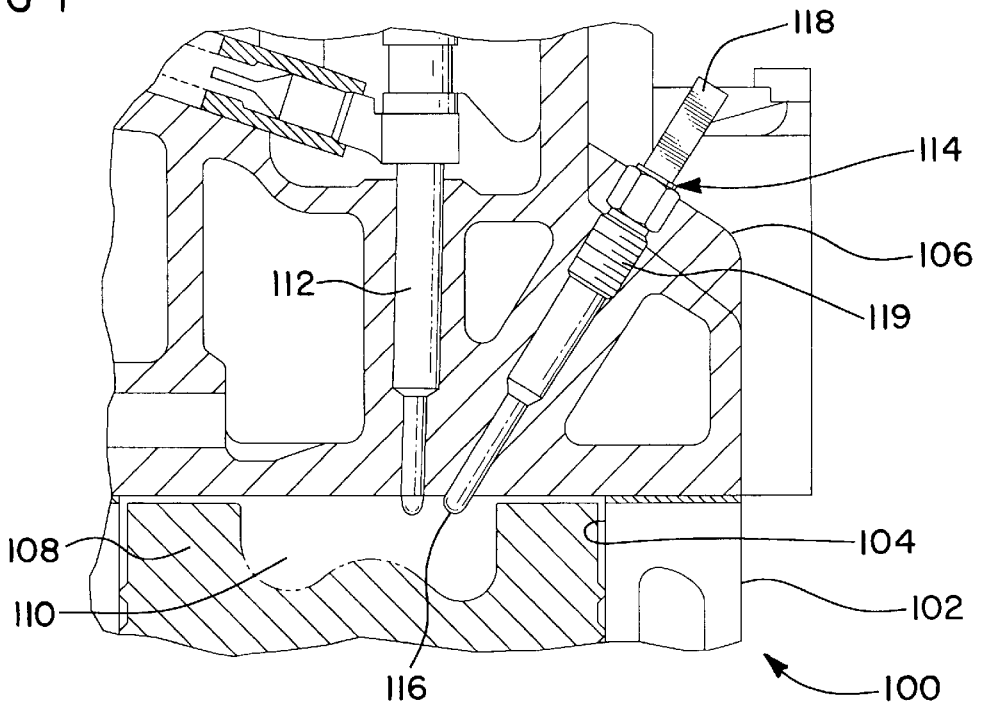
PRIOR ART FIG 1
FIG. 1 is a fragmentary cross-sectional view of an open chamber diesel engine having direct injection of fuel into the combustion chamber and a prior art glow plug with a glow tip extending into the combustion chamber.
Figure 2:
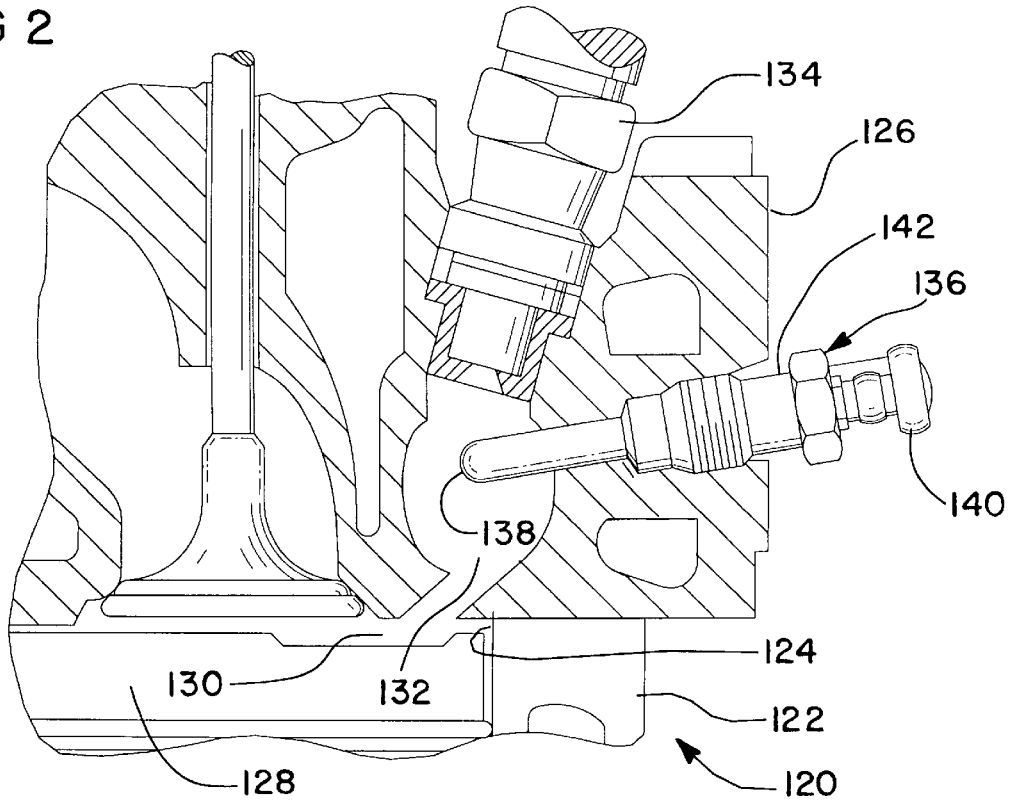
PRIOR ART FIG 2
FIG. 2 is a fragmentary cross-sectional view of a pre-chamber type diesel engine having indirect fuel injection into the pre-chamber and a prior art glow plug with a glow tip extending into the pre-chamber.

Referring first to FIGS. 1 and 2 of the drawings in detail, there are shown examples of prior art applications of diesel engine glow plugs to both open chamber and pre-chamber type diesel engines. These applications utilize glow plugs of a common type having a glow tip formed within a metal sheath. However, the use of other forms of glow tips in place of the metal sheath type glow plugs is also known.

In FIG. 1, numeral 100 generally indicates an open chamber type diesel engine having a cylinder block 102 defining a cylinder 104 closed by a cylinder head 106. A piston 108 is reciprocable in the cylinder 104 and defines a recessed bowl which, together with the cylinder head, forms a combustion chamber 110. The cylinder head 106 mounts an injection nozzle or injector 112 which sprays fuel into the combustion chamber 110 for compression ignition therein. The cylinder head also mounts a known form of glow plug 114 having a glow tip 116 extending into the combustion chamber. The glow tip is heated during cold engine starting and low temperature operation to assist in igniting fuel sprayed into the combustion chamber during periods when the temperature of compression may be insufficient to provide for proper fuel ignition and combustion.

The illustrated glow plug 114 is of the type having a metallic sheath forming the glow tip. A terminal 118 is provided at the outer end of the glow plug for connection with a source of electric current. Return current flow is from the metal sheath of the glow tip to a metal shell 119 of the glow plug and to the cylinder head in which the shell is mounted and which is grounded to the electrical system.

Referring to FIG. 2, numeral 120 indicates a pre-chamber type diesel engine having a cylinder block 122 with a cylinder 124 closed by a cylinder head 126 and carrying a piston 128 reciprocable in the cylinder. The piston and cylinder head form a combustion chamber 130 which connects with a pre-combustion chamber or pre-chamber 132 within the cylinder head. A fuel injector 134 is mounted in the cylinder head for injecting fuel into the pre-chamber 132. A glow plug 136 of known form has a glow tip 138 extending into the pre-chamber to assist in igniting the fuel during starting and cold operation. A terminal 140 at the other end of the glow plug provides for connection to a source of electric current and the glow plug shell 142 is grounded to the cylinder head for completing the return current flow path as in the first described embodiment.

DESCRIPTION OF THE PREFERRED EMBODIMENT

The present invention provides a novel combination wherein components of glow sensors are combined with an engine component wherein the glow sensor elements are directly installed in a bore of a combustion chamber defining wall of the engine component, for example, an engine cylinder head. The glow sensor embodiments omit a supporting metal shell and instead install directly within a bore of the cylinder head or other component. This provides more room in the bore for electrical insulation materials or components having greater resistance value, as may be desirable for operation of the ion sensor functions. The terms "inner end" and "outer end" as used in the subsequent description and claims refer to directions of the glow sensor components as installed in an engine wherein the glow tip forms an inner end extending within a combustion chamber (including a pre-chamber) and electrical terminals are located at an outer end extending outside the engine cylinder head.

Figure 3:
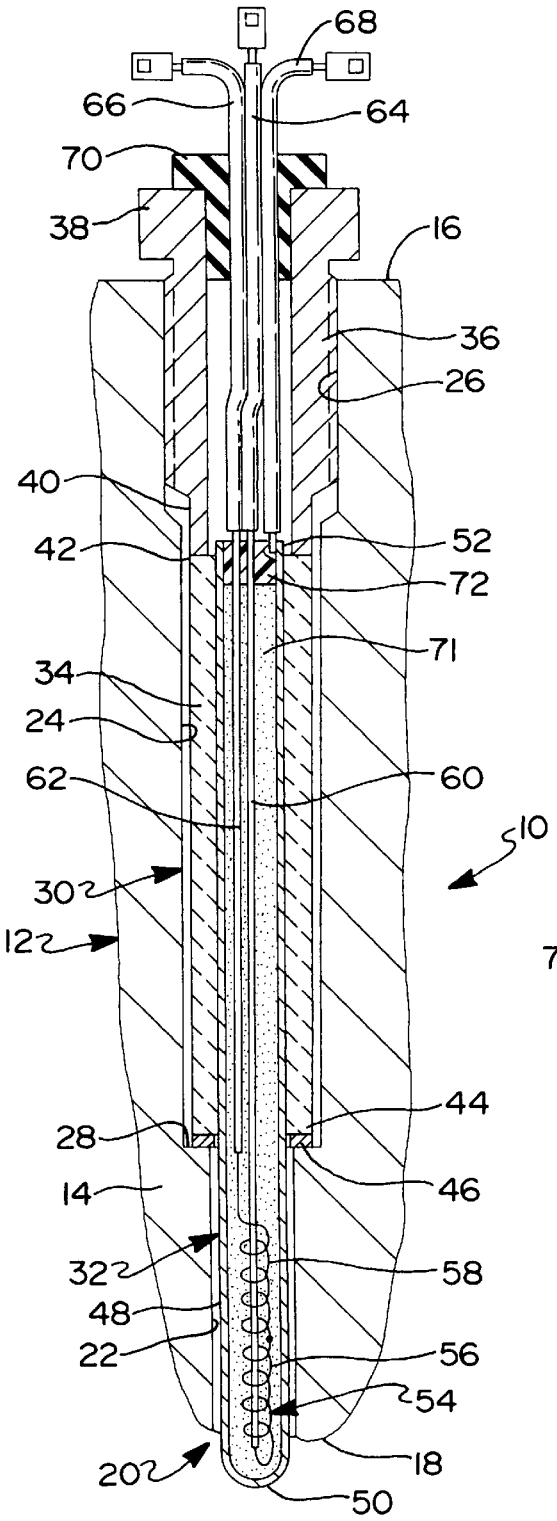
FIG. 3 is a transverse cross-sectional view of a first embodiment of glow sensor and engine component combination formed according to the invention.

Referring now to FIG. 3 of the drawings, numeral 10 generally indicates a combination according to the invention comprising an engine cylinder head 12 having a wall 14. Wall 14 includes an outer surface 16 and an inner surface 18, the latter defining a portion of a diesel engine combustion chamber, not shown. A mounting bore 20 extends through the wall and includes a smaller diameter portion 22 located adjacent the combustion chamber defining surface 18. A larger diameter portion 24 is located intermediate the ends of the bore and securing means in the form of internal threads 26 are provided in an outer portion of the bore having a still larger diameter. An annular seat 28 is formed at the inner end of the larger diameter portion 24 where it adjoins the smaller diameter portion 22 of the bore.

Mounted within the bore 20 are the components of a glow sensor generally indicated by numeral 30. Glow sensor 30 includes a glow sensor element 32, a tubular ceramic sleeve 34 and a tubular threaded nut 36.

In assembly, the ceramic sleeve 34 is preferably silver brazed or otherwise fixed to the glow sensor element 32, forming an assembly. The tubular nut has a hexagonal outer end 38 and an annular inner end 40 which, in assembly, engages an outer end 42 of the ceramic sleeve 34. Upon tightening of the nut 36, an inner end 44 of the sleeve 34 is forced against a gasket 46, formed, for example, of copper or soft steel, which is preferably cemented to the sleeve prior to assembly. The gasket engages the annular seat 28 in the mounting bore and provides a combustion gas seal preventing gas leakage around the exterior of the ceramic sleeve. Leakage between the ceramic sleeve 34 and the glow sensor element 32 is prevented by the silver brazed joint.

The elements of the combination so far described are essentially common for the several embodiments of the invention to be described so that like numerals are used for like parts or features. Differences in the embodiments arise primarily from differences in the glow sensor elements used in the various embodiments.

In the embodiment of FIG. 3, glow sensor element 32 comprises a tubular metal sheath 48 having a closed inner end 50, defining a glow tip, and an open outer end 52. The inner end 50 extends inwardly from the smaller diameter portion 22 of bore 20 through the inner surface 18 of the cylinder head into the combustion chamber or pre-chamber of an associated diesel engine. Within the glow tip is a heating element 54 which may comprise a heater coil 56 connected outwardly with a current regulating coil 58. However, other forms of heating coils may also be utilized.

The inner end of the heating element 54 is connected to a central conductor 60 while the opposite end of the heating element is connected with a second conductor 62. Conductors 60, 62 extend outwardly from their connections with the heating element through the open end of the metal sheath where they are respectively connected with conductive leads 64, 66. A third lead 68 connects with the open end of the metal sheath 48. The three leads 64, 66, 68 extend up through the hollow nut 36 and out through a rubber sealing plug 70 where they are connected externally with terminal clips for connection with an electric power source. The interior of the metal sheath 48 is packed with ceramic insulation 71, such as magnesium oxide (MgO), to support the heating coil and conductors. A rubber or plastic sealing plug 72 is forced into the open inner end of the sheath to retain the insulation therein and support the conductors 60, 62 extending therethrough.

In operation lead 68 is connected in an external ion sensor circuit which provides a positive charge on the metal sheath so that it may act as an ion sensor electrode within the engine combustion chamber. When there is a combustion event, electrons in the ionized combustion gas will conduct current from the metal sheath 48 to the piston or cylinder head which is grounded. Lead 66 is grounded and lead 66 is connected with the positive terminal of an electric power source. Leads 64, 66 supply electric current to the heating element of the glow sensor when desired so as to heat the glow tip of the glow sensor element and thereby aid in ignition of fuel during starting and cold running operation of the associated diesel engine.

Figure 4:
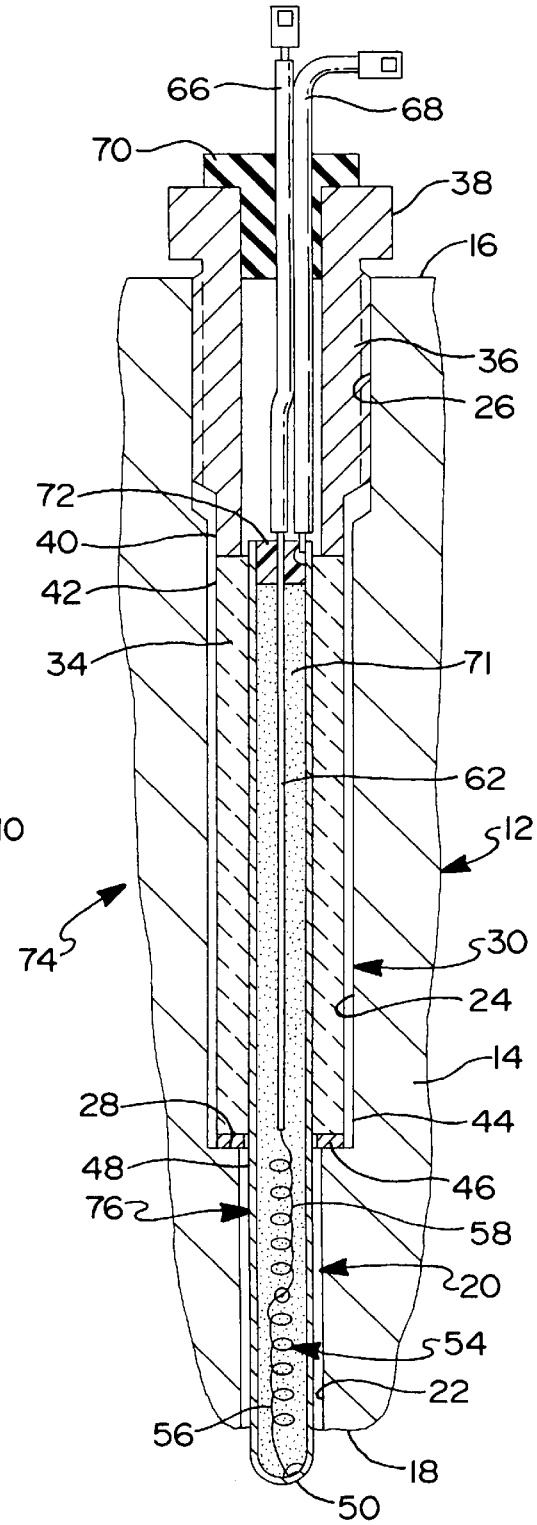
FIG. 4 is a transverse cross-sectional view of a second embodiment of glow sensor and engine component combination formed according to the invention.

Referring now to FIG. 4 of the drawings, there is shown a second combination according to the invention and generally indicated by numeral 74. Combination 74 includes a cylinder head 12 having the features previously indicated with respect to the first embodiment. Within the cylinder head are glow sensor components which are identical to those previously described except for the glow sensor element 76. Element 76 is similar to that previously described except that the inner end of the heating element 54 is directly connected with the closed inner end 50 of the metal sheath 48. Thus only a single conductor 62 is provided within the metal sheath 48 and it is connected to the outer end of the heating element 54. Conductor 62 then extends through the plug 72 in the outer end of the metal sheath 48 and connects with a single ground lead 66 that penetrates the plug 70 which seals the open outer end of the tubular nut 36. Thus, with this embodiment, the positively charged lead 68 that connects with the metal sheath 48 provides a positive charge not only for the ion sensing function of the glow tip electrode but also to provide current to the heating element 54 for the combustion assisting function of the glow sensor.

Referring now to FIG. 5 of the drawings, there is shown a third combination 78 formed according to the invention and including a cylinder head 12 configured as before and other elements differing only in the form of the glow sensor element generally indicated by numeral 80.

Element 80 is formed from a ceramic rod 82 of a ceramic material such as silicon nitride ($Si_3N_4$). The ceramic rod 82 has molded therein a heater element 54 connected with first and second conductors 60, 62. The heating element 54 is located in the inner end of the rod which forms a glow tip. On the exterior of the rod end there is printed an ion sensor electrode 84 of platinum or palladium ink. This electrode connects with a third conductor 86 of printed conductive ink, extending up the exterior of the ceramic rod 82 from the ion sensor electrode 84 to the outer end of the rod. A protective and insulating ceramic coating 87, such as aluminum oxide or glass, covers the surface of the rod from adjacent, but not at, the inner end that forms the ion electrode to the outer end. The coating 87 protects the third conductor 86 from exposure to combustion gases. The three conductors 60, 62 and 86 connect with leads 64, 66, 68 as in the first described embodiment. One other difference is that the ceramic sleeve 34 is fixed to the ceramic coated rod 82 by an adhesive cement bond, glass seal, or other suitable means, not shown, capable of providing a combustion gas seal as well as structural adhesive characteristics.

FIG. 5A of the drawings shows a variation of the third combination of FIG. 5 wherein the ceramic rod 82 has a third conductor 88 molded therein in place of the printed external conductor 86 of FIG. 5. Conductor 88 may be made of tungsten or the like and connects, through a short connector 89 of platinum or palladium ink, with the ion sensor electrode 84 on the tip of the ceramic rod 82. The connector 89 protects the tungsten wire 88 from corrosion due to exposure to combustion gases. The tungsten wire 88 extends through the ceramic rod 82 to its inner end where it is connected to the third lead 68 (shown in FIG. 5) for connection in the ion sensor circuit.

With this variation, the ceramic coating 87 may be omitted from the rod 82. Also, the ceramic sleeve 34 could be used as is or a metal sleeve could be substituted if desired, since the insulation of the ceramic rod may be sufficient without another ceramic member. In this case, the ground conductor 62 could be grounded through the metal sleeve and the nut 36 to the cylinder head instead of connecting with insulated lead 66.

Figure 6:
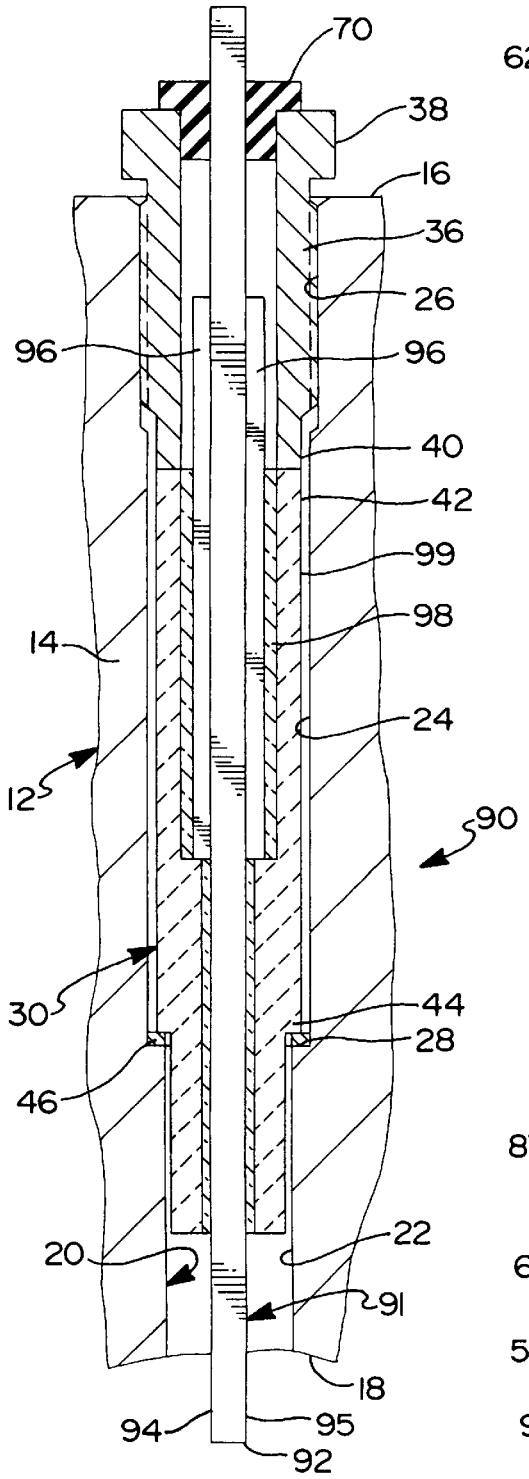
FIG. 6 is a transverse cross-sectional view of a fourth embodiment of glow sensor and engine component combination formed according to the invention.
Figure 7:
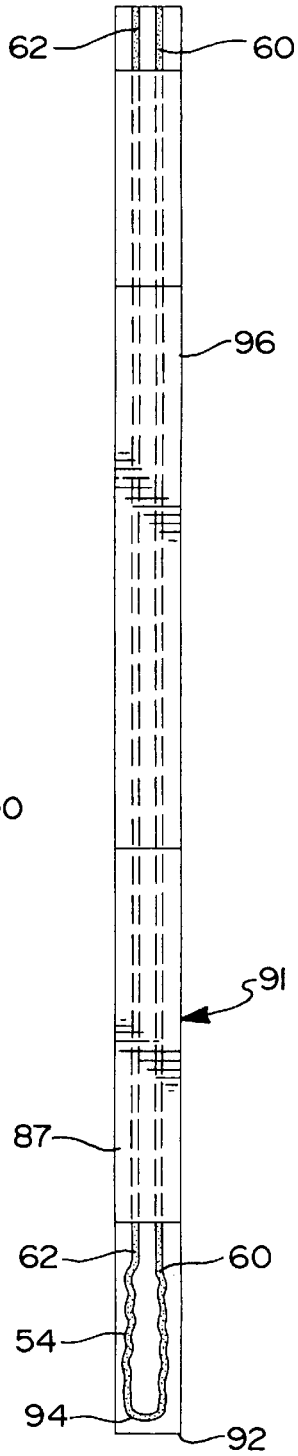
FIG. 7 is a view of a first side of the glow sensor element of FIG. 6, partially broken away to show the heating element and conductors.
Figure 8:
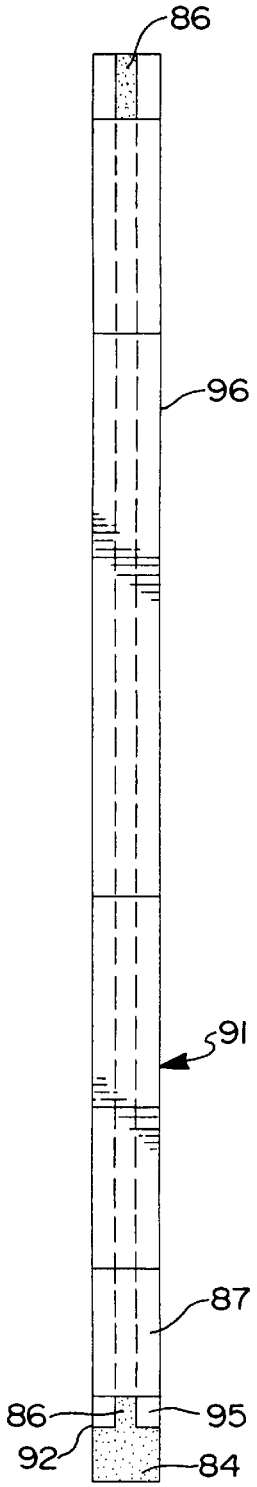
FIG. 8 is a view of a second side of the glow sensor element of FIG. 6.

Referring now to FIGS. 6–8, there is shown a fourth combination formed according to the invention and generally indicated by numeral 90. Here the cylinder head 12 as before carries a glow sensor element 91 in the form of a ceramic flat plate 92. The flat plate 92 extends completely through the mounting bore 20 and has first and second sides 94, 95. The heating element 54 is printed in platinum or palladium ink on the first side 94 of the flat plate, adjacent the inner end which forms the glow tip. Conductors 60, 62 are printed on the same side and extend from the heating element 54 to the outer end of the flat plate 92. On the second side 95 of the flat plate, an ion sensor electrode 84 is printed in platinum or palladium ink and connects with a third conductor 86 that extends from the electrode 84 to the outer end of the second side 95 of the flat plate. At the outer end, the conductors 60, 62, 86 are exposed for connection with a separate terminal clip, not shown, that provides electric power to the heater element 54 and the ion sensor electrode 84.

Any suitable means may be used to support the flat plate 92 within the mounting bore 20. In the present illustration the glow sensor element 91 includes laminated ceramic lugs or shoulders 96 adhered upon a protective coating 87 which covers the printed conductors to prevent their exposure to combustion gases and the like. These shoulders 96 are supported by glass seal or other insulation material 98 within a ceramic sleeve 99. Although somewhat longer, sleeve 99 functions in the same manner as ceramic sleeve 34 of the previously described embodiments to fix the glow sensor element in position within the mounting bore. A tubular nut 36 engages the ceramic sleeve 99 to hold it in position against a sealing gasket 46 as previously described.

As used in the claims, the term "combustion chamber" is intended to include a pre-chamber or precombustion chamber within its scope.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. The combination of a glow sensor and a combustion chamber defining component of a diesel engine, said combination comprising:

an engine component including a wall having a combustion chamber defining surface and a mounting bore through the wall and opening through said surface, said bore having a smaller diameter portion at an inner end adjacent said surface, a larger diameter portion spaced from said surface and defining an annular seat adjacent said smaller diameter portion, and securing means adjacent an outer end of the bore;

a glow sensor element extending through said bore and having a glow tip protruding inwardly from said smaller diameter portion through said surface;

a ceramic sleeve disposed in said larger diameter portion and fixedly connected to and surrounding said element, said sleeve having an annular inner end operatively engaging said annular seat; and a retainer operatively engaging said securing means and having an inner end bearing against an outer end of said sleeve and applying an axial force thereon to force the sleeve outer end against the bore annular seat and retain the glow sensor element in fixed assembly with said component.

2. A combination as in claim 1 and including a sealing gasket compressed in an interface between the annular inner end of said sleeve and the annular seat of said bore to form a combustion gas seal at the interface.

3. A combination as in claim 1 wherein said securing means comprise internal threads in the bore and said retainer comprises a threaded tubular nut having a tool engagable head and an axial opening therethrough.

4. A combination as in claim 1 wherein said engine component is a cylinder head.

5. A combination as in claim 1 wherein said glow sensor element comprises a ceramic flat plate having an electric heating element and conductors printed on a first side and an ion sensor electrode and conductor printed on a second side, an insulating coating on both sides of the flat plate and covering the printed conductors and the heating element for protection from combustion gases, the ion sensor electrode remaining exposed for conducting electric current within the combustion gases.

6. A combination as in claim 5 wherein insulation is packed between portions of the flat plate glow sensor element and the ceramic sleeve to support the element in the sleeve and provide a combustion gas seal therebetween.

7. A combination as in claim 1 wherein said glow sensor element comprises a tubular metal sheath having a closed inner end defining said glow tip, a heating element within the glow tip and connected with first and second conductors extending to an open opposite end of the sheath, insulation within the sheath and supporting the heating element and at least one of said conductors, the metal sheath comprising an electrical conductor connectable with a source of electric voltage for charging the sheath to act as an electrode of an ion sensor, and connecting means extending from the bore for connecting said conductors to an external electrical power source.

8. A combination as in claim 7 wherein said ceramic sleeve is brazed to the metal sheath to form a combustion gas seal and maintain the sleeve and sheath in assembly.

9. A combination as in claim 7 wherein said heating element has one end connected with the sheath at its glow tip and another end connected with the second conductor, the sheath acting as said first conductor of electric current to the heating element as well as said electrode of the ion sensor.

10. A combination as in claim 7 wherein said heating element has opposite ends connected with said first and second conductors, the sheath acting as a third conductor.

11. A combination as in claim 1 wherein said glow sensor element comprises a ceramic rod having an inner end defining said glow tip, a heating element within the glow tip and connected with first and second electrical conductors extending to an open opposite end of the sheath, an electrically conductive layer on the glow tip and connected with a third electrical conductor, and connecting means extending from the bore for connecting said conductors to an external electrical power source.

12. A combination as in claim 11 wherein said ceramic sleeve is brazed to the ceramic rod to form a combustion gas seal and maintain the sleeve and rod in assembly.

13. A combination as in claim 11 wherein said third conductor is carried on the exterior of the ceramic rod and said ceramic sleeve insulates the third conductor from said engine component.

14. A combination as in claim 11 wherein said third conductor is molded within the ceramic rod.

* * * * *